US006352391B1

(12) United States Patent
Jones

(10) Patent No.: US 6,352,391 B1
(45) Date of Patent: Mar. 5, 2002

(54) PIERING DEVICE HAVING A THREADED SHAFT AND HELICAL PLATE

(76) Inventor: Robert L. Jones, 29505 Golden Gate Canyon Rd., Golden, CO (US) 80403

( * ) Notice: Subject to any disclaimer, the term of this patent is extended or adjusted under 35 U.S.C. 154(b) by 0 days.

(21) Appl. No.: 09/460,086

(22) Filed: Dec. 14, 1999

(51) Int. Cl.[7] ..... E02D 5/00
(52) U.S. Cl. ..... 405/252.1; 405/253; 405/251
(58) Field of Search ..... 405/252.1, 251, 405/253, 255; 403/286, 299, 305, 343, 359.1, 359.6

(56) References Cited

U.S. PATENT DOCUMENTS

| | | | | |
|---|---|---|---|---|
| 414,700 | A | | 11/1889 | Gray |
| 2,234,907 | A | | 3/1941 | Williams |
| 2,467,826 | A | * | 4/1949 | Henderson et al. ..... 285/1 |
| 3,016,117 | A | | 1/1962 | Petersen |
| 4,239,419 | A | * | 12/1980 | Gillen ..... 405/232 |
| 4,290,245 | A | * | 9/1981 | Pardue et al. ..... 52/157 |
| 4,334,392 | A | | 6/1982 | Dziedzic |
| 4,833,846 | A | | 5/1989 | McFeetors et al. |
| 4,911,580 | A | | 3/1990 | Gregory et al. |
| 4,979,341 | A | | 12/1990 | Norman et al. |
| 5,011,336 | A | | 4/1991 | Hamilton et al. |
| 5,120,163 | A | | 6/1992 | Holdeman et al. |
| 5,139,368 | A | | 8/1992 | Hamilton et al. |
| 5,171,107 | A | | 12/1992 | Hamilton et al. |
| 5,213,448 | A | | 5/1993 | Seider et al. |
| 5,408,788 | A | | 4/1995 | Hamilton et al. |
| 5,570,975 | A | | 11/1996 | Reinert |
| 5,800,094 | A | | 9/1998 | Jones |

FOREIGN PATENT DOCUMENTS

| | | | |
|---|---|---|---|
| JP | 5-287996 A | * | 11/1993 |
| JP | 6-193055 A | * | 7/1994 |
| WO | WO 82/00672 | | 4/1982 |

* cited by examiner

*Primary Examiner*—David Bagnell
*Assistant Examiner*—Jennifer R. Dougherty
(74) *Attorney, Agent, or Firm*—Dorr, Carson, Sloan & Birney, P.C.

(57) ABSTRACT

A piering device employs a threaded shaft and a helical bearing plate with a threaded passageway that allows the helical plate to be advanced to any desired location along the shaft. The helical plate can also be readily replaced with one or more helical plates of different sizes. The threaded shaft has a key way extending along its length. The threaded passageway of the helical plate can also be equipped with a key way extending its length. A key is removably inserted into the shaft key way and helical plate keyway after these key ways have been rotated into alignment to secure the helical plate at the desired location along the shaft.

17 Claims, 2 Drawing Sheets

PIERING DEVICE HAVING A THREADED SHAFT AND HELICAL PLATE

BACKGROUND OF THE INVENTION

1. Field of the Invention

The present invention relates generally to the field of helical pilings or screw piles. More specifically, the present invention discloses a piering device having a threaded shaft and helical bearing plate.

2. Statement of the Problem

Piering systems have long been used to lift and stabilize foundations of structures, and also in new construction. Some systems employ piles that are driven into the ground adjacent to the foundation, while other piering systems employ helical piles that are screwed into the ground. These piles are also used to anchor structures (e.g., large antennas, or pylons for high voltage lines) that are subject to large wind loads.

Conventional helical piles have an elongated shaft with a helical bearing plate permanently attached to the shaft adjacent to its lower end. The shaft can either be solid or tubular. For example, A. B. Chance Company of Centralia, Mo., markets helical piles having a solid shaft with a substantially square cross-section. The lower end of the shaft is beveled to form a point. The helical bearing plate is welded to the lower end of the shaft adjacent to the bevel. The length of the shaft is fixed, as are the diameter and location of the helical plate. In addition, some installations require several helical plates of different diameters spaced along the shaft. All of this can result in an substantial inventory problem to ensure that the appropriate helical piles are in stock for each job, particularly due to the size and expense of these helical piles.

It is also difficult to accurately predict the length of the piles that will be required for a specific job. Helical pilings are typically screwed into the ground to a point at which a predetermined torque limit is reached. It is difficult to predict what the depth of insertion will be when this torque limit is reached, due primarily to the unpredictable nature of local soil conditions. Therefore, it is often necessary to add an extension to the shaft of the helical pile. For example, A. B. Chance Company markets an extension shaft having a square socket that fits over the upper end of the helical pile shaft. A bolt can be passed through aligned holes in the socket of the extension shaft and the upper end of the helical pile shaft to secure the extension shaft to the helical pile. However, these holes significantly weaken the assembly.

A related problem arises if the shaft of the helical pile is too long. In this case, the upper end of the shaft must be cut off and a new hole must be drilled through the shaft to secure the shaft to the support bracket needed to engage the foundation. This can be difficult and time-consuming in the field.

Thus, a need exists for a helical piling system that is modular in design so,that helical plates of various sizes and diameters can be used interchangeably, and various helical plates can be interchangeably combined with a shaft of a desired length. In addition, there is a need to be able to quickly and easily connect shafts to one another in the field to create a shaft assembly of desired length.

Other examples of helical pilings that have been used in the past include the following:

| Inventor | Patent No. | Issue Date |
|---|---|---|
| Gray | 414,700 | Nov. 12, 1889 |
| Grimaud | France 561,975 | Mar. 10, 1925 |
| Williams | 2,234,907 | Mar. 11, 1941 |
| Petersen | 3,016,117 | Jan. 9, 1962 |
| Schirm | PCT WO 82/00672 | March 4, 1982 |
| Dziedzic | 4,334,392 | June 15, 1982 |
| McFeetors et al. | 4,833,846 | May 30, 1989 |
| Gregory et al. | 4,911,580 | Mar. 27, 1990 |
| Norman et al. | 4,979,341 | Dec. 25, 1990 |
| Hamilton et al. | 5,011,336 | Apr. 30, 1991 |
| Holdeman et al. | 5,120,163 | June 9, 1992 |
| Hamilton et al. | 5,139,368 | Aug. 18, 1992 |
| Hamilton et al. | 5,171,107 | Dec. 15, 1992 |
| Hamilton et al. | 5,408,788 | Apr. 25, 1995 |
| Seider et al. | 5,213,448 | May 25, 1993 |
| Reinert | 5,570,975 | Nov. 5, 1996 |
| Jones | 5,800,094 | Sept. 1, 1998 |

Gray discloses a threaded pile with a threaded helical plate. After the pile has been driven into the ground, the plate 10 is advanced into the ground by rotating a handle 15 attached to a removable sleeve 13.

Dziedzic discloses a modular screw anchor having an earth-penetrating lead 16 that is separate from the helical plate 30. In the embodiment shown in FIGS. 2–6 of Dziedzic, the earth-penetrating lead and plate assembly are connected to a rectangular shaft. In the embodiment shown in FIGS. 7–10 of Dziedzic, the shaft is round with threads at its lower end to engage the earth penetrating lead 60.

Seider et al., Holdeman et al. and Gregory et al. disclose other examples of an apparatus for stabilizing the foundation of a building using a conventional helical piling that has been screwed into the ground.

U.S. Pat. Nos. 5,139,368 and 5,171,107 to Hamilton et al. disclose a system for underpinning a foundation that uses a helical pile with a connecting bracket secured to the foundation.

Schirm discloses a tie rod having a helical plate 3 and a moving foot 15 that can slide along the rod 2 limited by the position of a nut 31 threaded on the rod 2.

Grimaud is believed to relate to a pile foundation.

Reinert discloses a mobile foundation installation system having a push-it carriage that can push a metal foundation into the ground by hydraulic cylinders pushing against a header frame held and secured in adjustable positions on a mobile tower.

McFeetors et al. disclose a ground anchor system for supporting a structure. A fixed-length helical pile is driven into the ground. The upper end of the piling device includes a screw that allows adjustment of the height of the support head beneath the foundation.

Petersen discloses a screw anchor that receives a square shaft. The anchor is held in place by a pin extending through the anchor and the shaft.

Williams, Norman et al. and Hamilton et al. (U.S. Pat. No. 5,408,788) show examples of screw anchors that can be threaded onto the lower end of a shaft.

Jones discloses a support bracket for attachment to the top of a conventional helical piling.

3. Solution to the Problem

None of the prior art references uncovered in the search show a helical piling with a threaded shaft and helical plate.

This allows the appropriate helical plate(s) to be threaded on the shaft to meet the specific needs of each job. After the helical plate has been threaded to the desired location on the shaft, the helical plate is held in place by inserting a removable key into the longitudinal slot extending the length of the shaft. The shaft can also be cut to the desired length without waste.

The shaft and helical plate of a helical piling are subject to enormous torsional loads during installation, and very large axial loads (either in compression or tension) after the helical piling has been placed in use. None of the prior art references uncovered in the search teach or suggest a threaded arrangement with a removable key to transmit these loads.

SUMMARY OF THE INVENTION

The present invention is a piering device having a threaded shaft and a helical bearing plate with a threaded passageway that engages the threaded shaft. This allows the helical plate to be advanced to any desired location along the shaft. The helical plate can also be readily replaced with one or more helical plates of different sizes and diameters. The threaded shaft has a key way or slot extending along its length. The threaded passageway of the helical plate can also be equipped with a key way or slot. A key is removably inserted into the shaft key way and helical plate keyway after these key ways have been rotated into alignment to secure the helical plate at the desired location along the shaft.

A primary object of the present invention is to provide a helical piling having modular components that can be readily combined and configured to meet the requirements of a wide variety of jobs.

Another object of the present invention is to provide a helical piling that greatly minimizes inventory requirements.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
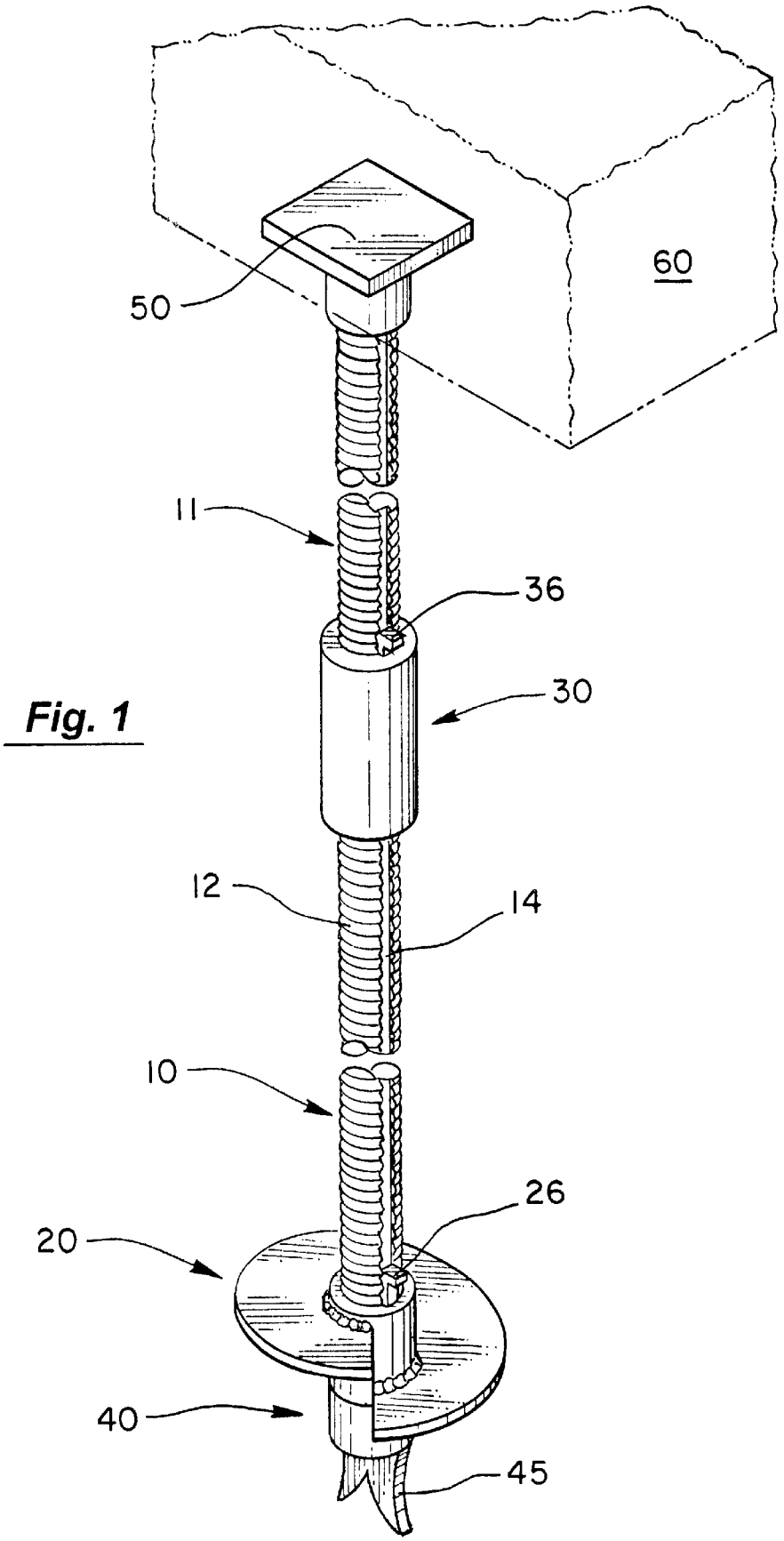
FIG. 1 is a perspective view of the present invention.
Figures 2, 3:
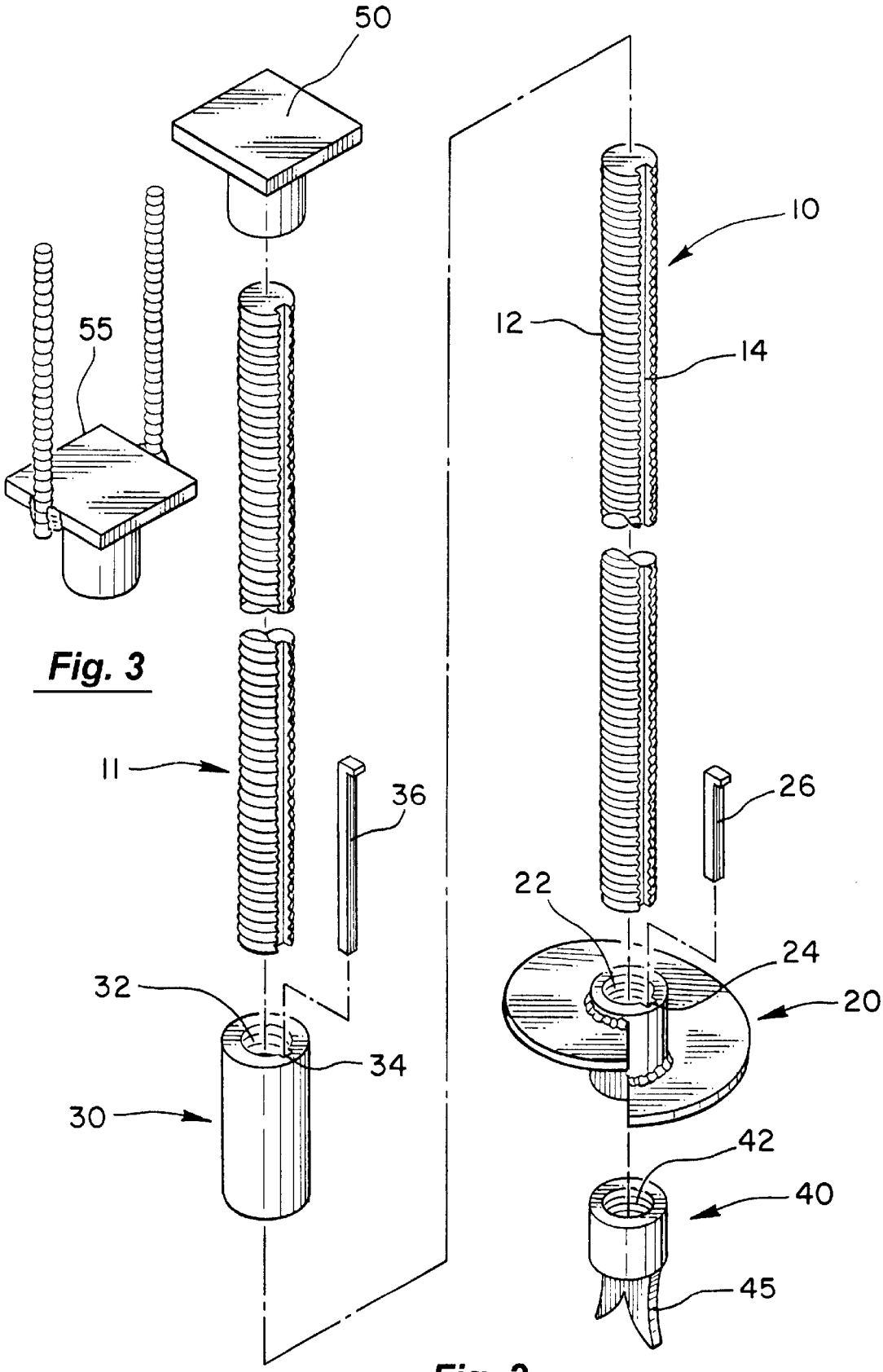
FIG. 2 is an exploded perspective view of the present invention corresponding to FIG. 1.
FIG. 3 is a perspective view of an alternative "rabbit ears" attachment bracket that can be threaded onto the upper end of the shaft in place of the support bracket shown in FIGS. 1 and 2.

Turning to FIG. 1, a perspective view is provided of the present device. A corresponding exploded perspective view is shown in FIG. 2. In general terms, the present device consists of a piering shaft 10 having threads 12 and a longitudinal key way 14, and a helical bearing plate 20 having a threaded passageway to receive and engage the threaded shaft 10. The helical plate 20 can be threaded along the shaft 10 to any desired position, and then secured to the shaft 10 by inserting a key 26 into the shaft keyway 14 as illustrated in FIG. 1.

The shaft 10 can have any of a number of possible configurations. In the preferred embodiment, the key way 14 extends along the entire length of the shaft 10. This simplifies fabrication of the shaft 10 and allows the helical plate 20 to be positioned anywhere on the shaft 10. This also makes the present device more modular by enabling two or more shafts 10, 11 to be connected in series, as described below. However, the key way 14 could be limited to selected portions of the shaft 10. At minimum, a key way should extend along the lower end of the shaft 10 to provide a range of positions for the helical plate 20, and a short key way should extend adjacent to the upper end of the shaft 10 to engage a coupler 30 if an extension shaft 11 is needed. The shaft 10 can also be equipped with multiple key ways spaced around the periphery of the shaft 10. In the preferred embodiment, the shaft key way 14 has a substantially rectangular cross-section, since this can be readily formed using conventional milling techniques. However, other cross-section shapes could be employed.

Any of a variety of thread configurations can be used on the shaft 10. The preferred embodiment uses a rope thread 12 extending the entire length of the shaft 10. This type of threaded shaft is commercially available and the rounded shape of the thread 12 makes its easier to handle and somewhat less susceptible to damage. Here again, the thread 12 could be limited to selected portions of the shaft, such as the lower end of the shaft 10 to provide a range of positions for the helical plate 20 and a upper end of the shaft 10 to engage a coupler 30, if necessary.

A coupler 30 can be used to join two shafts 10, 11, if an especially long shaft is required, as depicted in FIG. 1. The coupler 30 is threaded on both shafts 10, 11 and then held in place by a removable key 36 inserted into the key ways 14 in the shafts 10, 11. The coupler 30 is shown in greater detail in the exploded view provided in FIG. 2. It has a threaded passageway 32 extending between two axially-aligned openings that receive the shafts 10 and 11. The shafts 10, 11 are screwed into opposite ends of the coupler 30 until the ends of the shafts 10, 11 abut and the key ways 14 of the shafts 10, 11 are aligned with one another. The coupler 30 is then removably secured to the shafts 10, 11 by inserting a key 36 into the aligned shaft key ways 14 and through the coupler 30. This configuration is advantageous in that the shafts 10 and 11, rather than the coupler 30, carry most of the large axial loads after installation of the pier. Alternatively, two shorter keys can be inserted from opposite ends of the coupler 30.

An axial key way 34 can be broached in the passageway through the coupler 30 to allow a larger key 36 to be used and to increase torsional strength of the assembly. The coupler key way 34 must then be properly aligned with both of the shaft key ways 14 before the key 36 is inserted. The coupler 30 can be equipped with multiple key ways 34 in a radial arrangement around the periphery of its threaded passageway 32 to simplify alignment with the shaft key ways 14.

In the preferred embodiment shown in the figures, the coupler 30 is simply a threaded cylindrical collar. However, other configurations of the coupler 30 are possible. For example, the coupler 30 could have a hexagonal outer cross-section so that it can be grasped by a wrench.

The helical plate 20 can also have any of a wide variety of configurations and sizes. In the embodiment shown in the figures, the helical plate has a generally cylindrical hub with a threaded passageway 22 extending completely through the hub. Alternatively, the hub of the helical plate 20 could have a hexagonal outer cross-section so that it can be grasped by a wrench. The plate is typically welded onto this hub, although other fastening means could be used.

As previously mentioned, the threads 22 of the helical plate 20 engage the corresponding threads 12 on the shaft 10, and thereby allow the helical plate 20 to be screwed to any desired location along the shaft. A removable key 26 is then inserted into the shaft key way 12 beneath the helical plate 20 to secure it in position to the shaft 10.

An axial key way 24 can also be broached in the threaded passageway 22 through the hub of helical plate 20 to allow a larger key 26 to be used and to increase torsional strength. The helical plate key way 24 must then be properly aligned with the shaft key way 14 before the key 26 is inserted.

A variety of optional features can be used with the present device. As shown in FIGS. 1 and 2, a cutting tip 40 can be threaded onto the lower end of the shaft 10. This cutting tip 40 is equipped with a threaded passageway 42 to engage the threaded shaft 10, and a set of cutting blades 45 to drill into the ground beneath the helical plate 20 and thereby reduce resistance as the helical piling is advanced into the ground. In the embodiment shown in the figures, the cutting tip 40 has a generally cylindrical hub with a threaded passageway 42 to engage the threaded shaft 10. Alternatively, the hub of the cutting tip 40 could have a hexagonal outer cross-section so that it can be grasped by a wrench.

A flat support bracket 50 can be threaded onto the upper end of the shaft 10 to support a building structure 60 as illustrated in FIG. 1. Other types of support brackets or attachment means can be threaded onto the upper end of the shaft to attach a load to the helical pile either in tension or compression. For example, the rabbit-ears attachment 55 shown in FIG. 3 be made an integral part of the concrete foundation of a building. Another type of adjustable support bracket that could be readily adapted for use with the present invention is disclosed in the Applicant's U.S. Pat. No. 5,800,094.

The above disclosure sets forth a number of embodiments of the present invention. Other arrangements or embodiments, not precisely set forth, could be practiced under the teachings of the present invention and as set forth in the following claims.

I claim:

1. A piering device comprising:

a threaded shaft having a key way extending along at least a portion of its length;

a helical plate having a threaded passageway to receive and engage said shaft, so that said helical plate can be threaded to any desired location along said shaft; and a key insertable into said key way to secure said helical plate at any desired location along said shaft.

2. The piering device of claim 1 wherein said key way comprises a slot extending the length of said shaft.

3. The piering device of claim 1 wherein said helical plate further comprises a key way extending along at least a portion of said threaded passageway for receiving said key when aligned with said key way of said shaft.

4. The piering device of claim 1 further comprising a coupler having a threaded passageway to receive and engage an end of said shaft.

5. The piering device of claim 4 wherein said coupler comprises a threaded passageway with two axially-aligned openings to receive and engage two threaded shafts.

6. The piering device of claim 4 wherein said coupler is removably secured to said shaft by inserting a key into said key way of said shaft.

7. The piering device of claim 1 further comprising a cutting tip having:

a cutting blade; and a threaded passageway to receive and engage an end of said threaded shaft.

8. The piering device of claim 1 further comprising a plurality of helical plates, each having a threaded passageway to receive and engage said shaft in series.

9. A piering device comprising:

a plurality of threaded shafts, each threaded shaft having a key way extending along at least a portion of its length;

at least one coupler having a threaded passageway with two axially-aligned openings to receive and engage two of said shafts; said couplers and shafts forming a unitary shaft assembly;

a helical plate having a threaded passageway to receive and engage one of said shafts in said shaft assembly, so that said helical plate can be threaded to any desired location along said shaft; and a key insertable into said key way to secure said helical plate at any desired location along said shaft assembly.

10. The piering device of claim 9 wherein said key way of at least one of said shafts comprises a slot extending the length of said shaft.

11. The piering device of claim 9 wherein said helical plate further comprises a key way extending along at least a portion of said threaded passageway for receiving said key when aligned with said key way of said shaft.

12. The piering device of claim 9 wherein said coupler is removably secured to each shaft by inserting a key into said key way of said shaft.

13. The piering device of claim 9 further comprising a cutting tip having:

a cutting blade; and a threaded passageway to receive and engage an end of one of said shafts.

14. The piering device of claim 9 further comprising a plurality of helical plates, each having a threaded passageway to receive and engage at least one of said shafts in series.

15. A piering device comprising:

a threaded shaft having a key way extending the length of said shaft;

a helical plate having a threaded passageway to receive and engage said shaft, so that said helical plate can be threaded to any desired location along said shaft; said threaded passageway further having a key way extending the length of said passageway; and a key removably insertable into said shaft key way and said helical plate keyway when said key ways are aligned to secure said helical plate at any desired location along said shaft.

16. The piering device of claim 15 further comprising a cutting,tip having:

a cutting blade; and a threaded passageway to receive and engage an end of said threaded shaft.

17. The piering device of claim 15 further comprising a plurality of helical plates, each having a threaded passageway to receive and engage said shaft in series.

* * * * *